United States Patent [19]

Witte

[11] 4,180,212

[45] Dec. 25, 1979

[54] HIGH SPEED ROTARY KNIFE AND BLADE INSERT ASSEMBLY THEREFOR

[75] Inventor: Walter R. Witte, Des Plaines, Ill.

[73] Assignee: Speco, Inc., Schiller Park, Ill.

[21] Appl. No.: 935,531

[22] Filed: Aug. 21, 1978

[51] Int. Cl.[2] ..... B02C 18/18

[52] U.S. Cl. ..... 241/89.4; 83/698; 241/282.1

[58] Field of Search ..... 83/698; 241/82.1, 82.4, 241/82.5, 89.4, 278 R, 282.1, 282.2; 144/230

[56] References Cited

U.S. PATENT DOCUMENTS

| | | | |
|---|---|---|---|
| 3,147,785 | 9/1964 | Schnell | 241/282.1 |
| 3,149,653 | 9/1964 | Schnell | 241/89.4 |
| 3,304,976 | 2/1967 | Schnell | 241/89.4 |

*Primary Examiner*—Mark Rosenbaum
*Attorney, Agent, or Firm*—Norman H. Gerlach

[57] ABSTRACT

A high speed rotary knife adapted in operation to rotate adjacent to a perforated plate for severing foodstuff projecting from the plate perforations includes a holder component and a blade held thereby. Improved structure is provided for mounting the blade, which includes means defining a hole in the blade extending transversely with respect to a cutting edge on the blade, and an arbor extending into the hole and fitting loosely in the hole for retaining the blade on the holder component while enabling the blade to rock about a transverse axis for automatically leveling the blade with respect to the plate during assembly with the plate and operation. The arbor may be withdrawn from the hole sufficiently to release the blade for replacement thereof.

16 Claims, 8 Drawing Figures

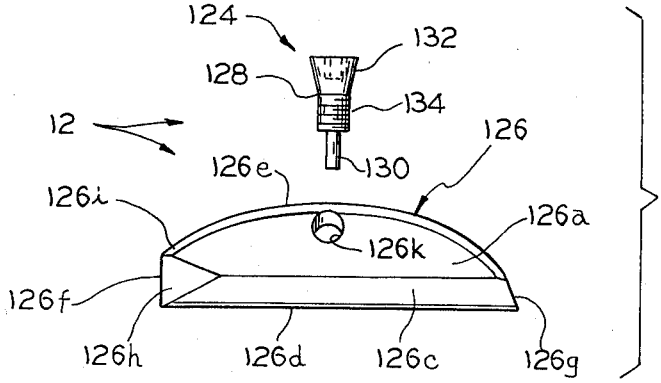
FIG. 6
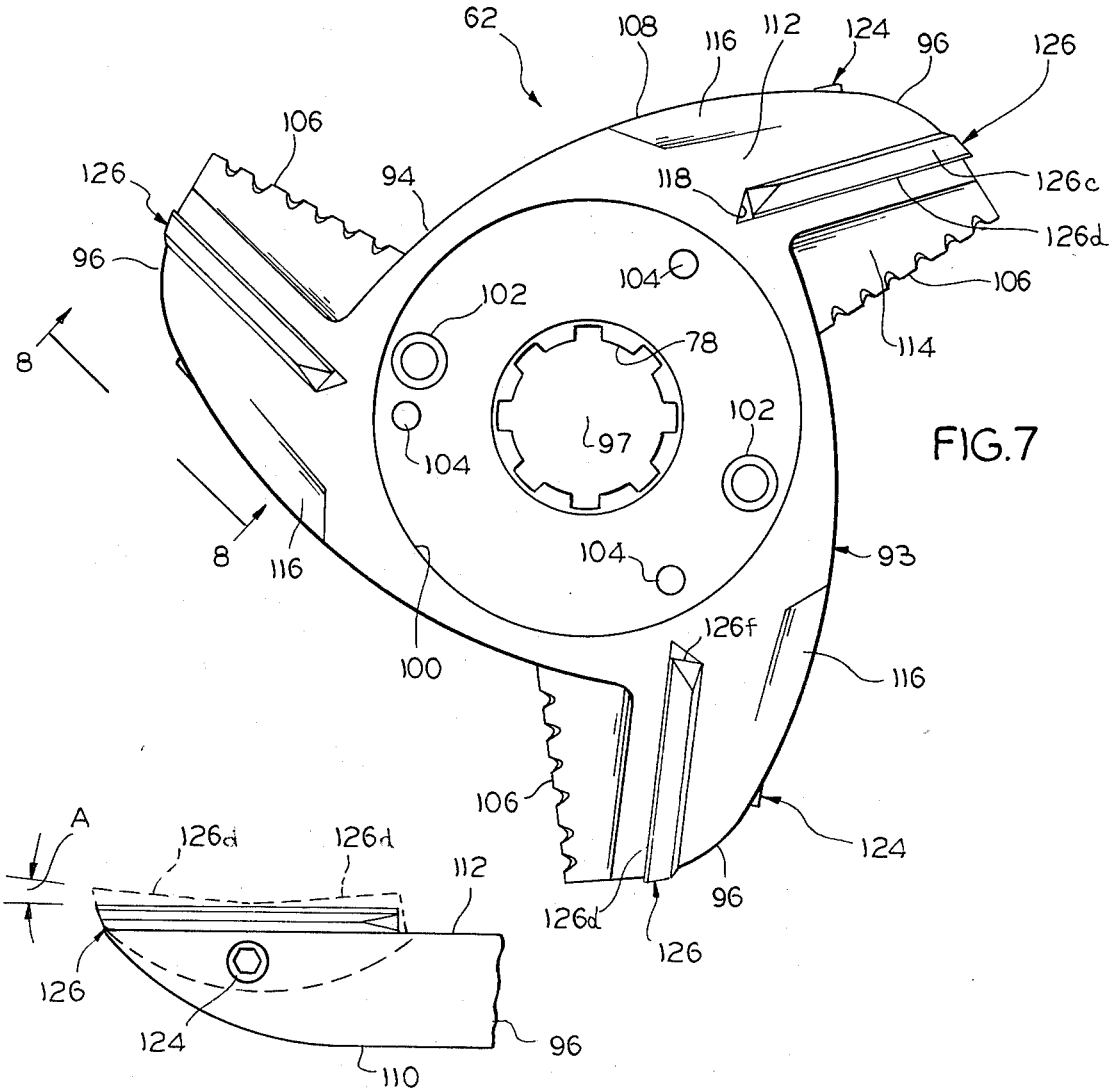
FIG. 7
FIG. 8

HIGH SPEED ROTARY KNIFE AND BLADE INSERT ASSEMBLY THEREFOR

BACKGROUND OF THE INVENTION

This invention relates to high speed rotary knives which are adapted in operation to rotate adjacent to perforated plates for severing foodstuff projecting from the plate perforations, especially knives which are employed in machines for comminuting foodstuffs. More particularly, the invention relates to such a knife having improved structure for mounting a blade thereof, which structure is adapted for automatic leveling of the blade with respect to an adjacent plate, and to a blade insert assembly for the knife.

Comminuting machines, such as disclosed in U.S. Pat. No. 3,304,976, are used for producing comminuted comestible products, including agricultural and animal products, particularly meat products, for making emulsions for sausages and the like. The machines include one or more high speed rotary knives, the knives being arranged in series when a plurality is employed, to produce a finer textured product, such as a meat emulsion.

In operation, the knives rotate adjacent to perforated plates, also referred to as valve plates, for severing foodstuff which has been propelled partly into and projects upstream from the plate perforations. The knives include blades which traverse the plates with cutting edges on the blades disposed on or against the upstream surfaces of the plates, to sever the foodstuff at the edges of the perforations.

In the type of knife with which the present invention is concerned, the knife includes a holder component which defines an arcuate-bottom slot adapted to receive a blade having an arcuate base seated therein, with the base at the bottom of the slot and conforming thereto, the blade so received being adjustable on the holder component by rotational sliding movement on its base, for leveling a cutting edge on the blade with respect to an adjacent plate. At the start of a conventional operation, the knives with blades therein are laid on the plates, or a jig is used, to level the cutting edges of the knife blades with respect to the plates. Set screws in threaded engagement with the holder components of the knives are tightened into engagement with the sides of the blades mounted in the slots, there being provided an indentation or a dimple on one side of each blade for engagement with a pointed inner end of a set screw. The pointed ends of the set screws mushroom in the indentations upon tightening, and fix the blades rigidly in place.

Despite care in fixing the knife blades in place, they have a tendency to move out of line. In such event, it is necessary to grind down the cutting edge of each non-aligned blade, which wastes expensive steel and shortens the useful life of the blade before operation even commences. Also, labor is required for the mounting and grinding operations.

The comminuting machines are operated with their knives rotating at high speeds, for example, at speeds on the order of 3,000 rpm. The knife blades extend over the perforated plates generally in radial directions from the axes of rotation of the knives. Consequently, the fixed blades and the plates wear unevenly, the wear increasing with increasing distance from the axis of rotation. Spaces may develop between the outer portions of the blades and the plates, smearing meat rather than cutting it cleanly, and/or the inner portions of the blades may gouge into the plates, to increase the wear and create undesirable heat in the product.

Under the most common conditions, the blades wear down and are removed and replaced after several hours of operation, for example. Each time the blades are replaced, they must be leveled and possibly ground to match the plates, with accompanying labor, wasted material, and shortened useful blade life. The worn perforated plates may be sharpened daily. Currently, titanium carbide-coated perforated plates are being introduced, and they materially reduce the wear and increase the useful life of the plates.

SUMMARY OF THE INVENTION

The invention provides a high speed rotary knife having blade mounting means which overcome the problems of leveling a knife blade with respect to an adjacent perforated plate, and a blade insert assembly for use in the knife, the knife being especially adapted for use in a machine for comminuting a foodstuff.

In particular, the invention provides such a knife embodying a "free-floating" blade which is self-leveling at all times, at the start of and during operation, requiring no labor or pre-grinding for leveling the knife blades, and providing maximum cutting efficiency with minimal wear during operation.

The blade insert assembly of the invention cannot be mounted incorrectly on a holder component of the knife, with accompanying damage to a perforated plate with which it cooperates. The waste of metal in pre-grinding operations is eliminated, and the blades retain their maximum useful life, with additional production as compared to the use of the prior blade inserts and their mounting means.

A high speed rotary knife to which the invention is applied in a preferred embodiment is adapted in operation to rotate adjacent to a perforated plate for severing foodstuff projecting from the plate perforations, and it includes a holder component, preferably a generally radially extending propelling arm, and a blade held thereby. The blade has a longitudinally extending cutting edge and a longitudinally arcuate base, and the holder component defines an arcuate-bottom slot receiving the blade seated therein with its base at the bottom of the slot in conformity thereto. The blade is adjustable on the holder component by rotational sliding movement on its base for leveling its cutting edge with respect to the plate, and the blade traverses the plate with the cutting edge thereagainst in operation. In accordance with the invention, improved means are provided for mounting the blade, including means defining a hole extending transversely in the blade from a side thereof, an arbor extending into the hole from the said side, the arbor fitting loosely in the hole for retaining the blade in the slot while enabling the blade to rock about a transverse axis for automatically leveling the blade with respect to the plate during assembly with the plate and operation, and means for mounting the arbor on the holder component while enabling the arbor to be withdrawn from the hole in the blade sufficiently to release the blade for replacement thereof.

The invention also provides a blade insert assembly for a knife of the foregoing character, wherein the holder component also defines an opening communicating with the slot therein and bounded by a threaded wall for receiving a set screw in threaded engagement with the holder component. The blade insert assembly includes a blade having a longitudinally extending cutting edge and a longitudinally arcuate base, and it is adapted for adjustable reception in the slot in the holder component, and for traversing the perforated plate in operation. The blade is provided with a hole extending transversely therein from a side thereof, the hole being disposed for communication with the opening in the holder component when the blade is received in the slot. The blade insert assembly also includes an arbor which comprises a set screw adapted to be received in the opening in the holder component, in threaded engagement therewith, and a pin on one end of the screw and adapted for extending therefrom into the hole in the blade when the blade is received in the slot. The pin fits loosely in the hole in the blade for retaining the blade in the slot in the holder component while enabling the blade to rock about a transverse axis for automatically leveling the blade with respect to the plate during assembly with the plate and operation. The set screw when unthreaded from the holder component acts to withdraw the pin from the hole in the blade sufficiently to release the blade for replacement thereof.

BRIEF DESCRIPTION OF THE DRAWINGS

The attached drawings illustrate a preferred embodiment of the invention, including a knife and a blade insert assembly therefor, as employed in a representative comminuting machine, without limitation thereto. In the drawings, like elements are identified by like reference symbols in each of the views; and:

FIG. 6 is an exploded side elevational view of a blade insert assembly employed in the knife, drawn on a slightly enlarged scale with respect to FIG. 5;

FIG. 7 is a plan view of the knife, taken from the opposite side to that illustrated in FIG. 3 and drawn on an enlarged scale with respect thereto; and FIG. 8 is a fragmentary elevational view of the knife, taken substantially on line 8—8 of FIG. 7 and illustrating in broken lines two alternate positions of a blade thereof.

DESCRIPTION OF THE PREFERRED EMBODIMENT

Figure 1:
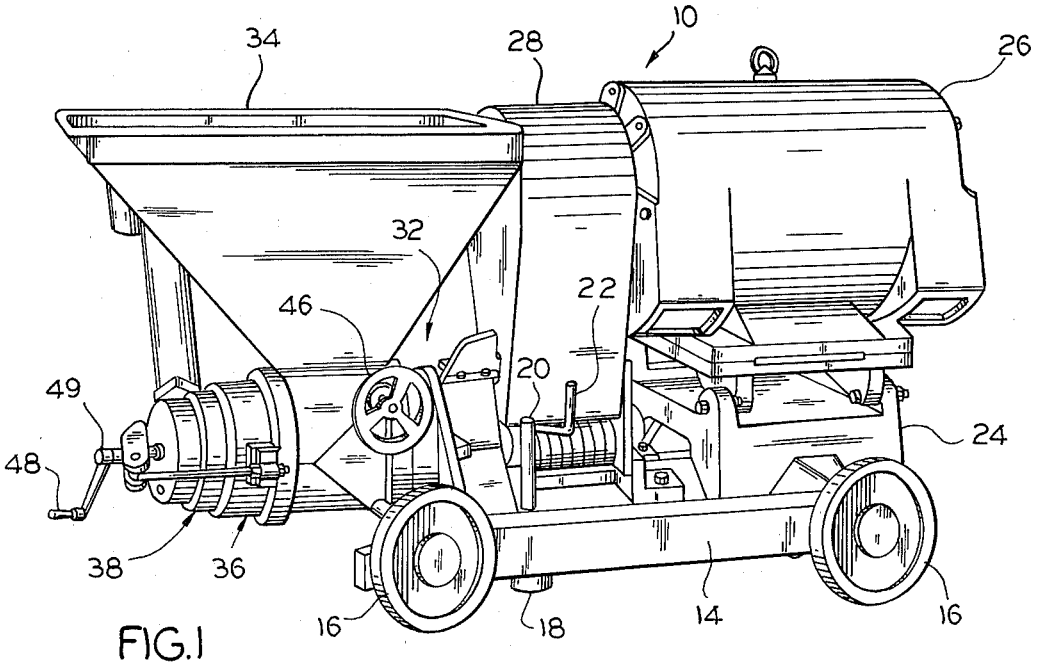
FIG. 1 is a side perspective view of a comminuting machine incorporating the invention.
Figure 2:
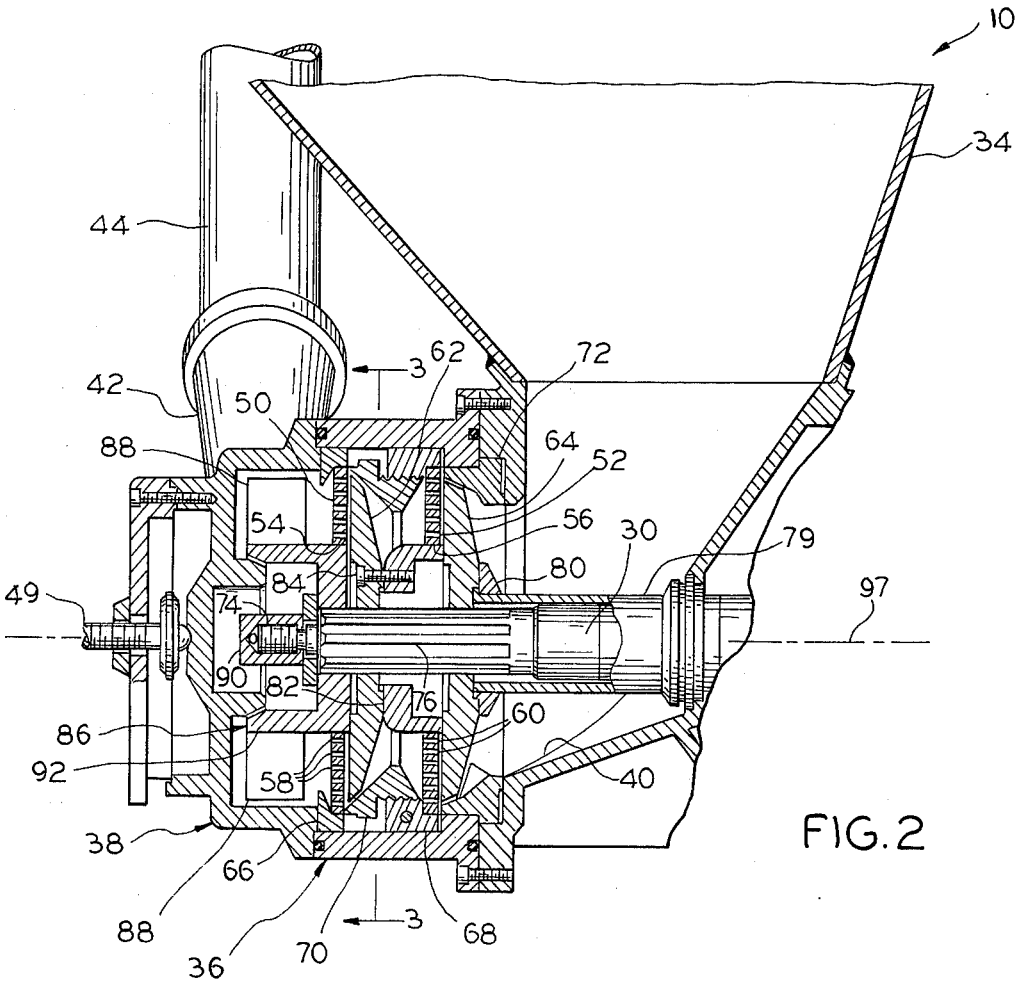
FIG. 2 is an enlarged longitudinal sectional and partly elevational view of a portion of the machine illustrated in FIG. 1.

Referring to the drawings, particularly FIGS. 1 and 2, the invention is illustrated as employed in a comminuting machine 10 which is the same as the comminuting machine 10 illustrated and described in U.S. Pat. No. 3,304,976, except for the substitution of the blade insert assembly 12 of the present invention, illustrated in FIG. 6, for a blade and set screw such as the blade 62 and the set screw 64 illustrated in FIGS. 9 and 10 of the patent. The application of the invention to the machine of the patent is merely illustrative, however, and the invention may be applied to other such machines and to other high speed rotary knives which are adapted in operation to rotate adjacent to a perforated plate for severing or shearing foodstuff projecting from the plate perforations.

The comminuting machine 10 is supported by a platform 14 having wheels 16 for moving the machine. Feet 18 are connected to adjustable legs 20, having a hand crank 22 connected thereto for braking the machine 10 when in use. A second platform 24 is mounted on the rear end of the wheeled platform 14 and supports an electric drive motor 26 thereon. A belt drive mechanism 28 couples the motor 26 to a drive shaft 30 (FIG. 2) which extends longitudinally of the machine 10.

The drive shaft 30 extends from a bearing housing 32 successively through a hopper 34 and an adjoining comminuting chamber 36 into a discharge chamber 38 adjoining the comminuting chamber, as illustrated in FIG. 2. The hopper 34 constitutes a stationary frusto-conical feed chamber or reservoir. The hopper 34 is connected to the comminuting chamber 36 by a curved inlet or neck portion 40 of the comminuting chamber. The discharge chamber 38 discharges through an outlet port 42 into a discharge nozzle 44, from where the product is discharged to a suitable receptacle. As disclosed in the patent, the machine is designed to produce during operation a continuous and moving hydraulic column of foodstuff, such as meat products, extending from the inlet 40 of the comminuting chamber at least to the outlet port 42.

The illustrative structure of the machine 10 also includes a handwheel 46 on one side of the machine, and a crank 48 connected to a discharge chamber-locking bolt 49 at the end of the machine adjacent to the discharge chamber 38. As described in the aforementioned patent, the handwheel 46 is operable for axially moving the drive shaft 30 and thereby adjusting the axial or longitudinal distances of two rotary propelling knives mounted on the shaft, relative to perforated or valve plates. The crank 48 is operable for tightening the discharge chamber 38 against the comminuting chamber 36, and for releasing the discharge chamber to provide access to that chamber and to the comminuting chamber 36. This structure is fully described in the patent and is unchanged in its use with the present invention.

Two spaced, vertically disposed annular downstream and upstream perforated plates or valve plates 50 and 52, respectively, are mounted in stationary positions in the comminuting chamber 36. The plates 50 and 52 are provided with relatively large central openings 54 and 56, respectively, and a plurality of relatively small openings 58 (see also FIG. 3) and 60 extending through the plates substantially throughout their areas. In the illustrative embodiment, the small openings 60 in the upstream plate 52 provide a relatively coarse cut of the foodstuff undergoing comminution, and the small openings 58 in the downstream plate 50 provide a relatively fine cut. In alternative structures, such as shown in other views of the patent, a single perforated plate may be employed, and there is but one cutting operation in the comminuting chambers thereof.

The downstream perforated plate 50 is mounted in a venturi ring 66, and the upstream perforated plate 52 is mounted in a base ring 68. The base ring 68 is adjustably secured to a crown 70, and the assembly of the base ring 68 and the crown 70 serves to space the perforated plates 50 and 52 a predetermined distance apart. An annular lug ring 72 on the upstream side of the upstream plate 52 secures the plates in place.

The comminuting machine 10 employs two high speed propelling knives 62 and 64, which are identical in the illustrative embodiment. The knives are mounted on the drive shaft 30 for rotation therewith, in the comminuting chamber 36. The knives 62 and 64 are mounted adjacent to the upstream faces of the perforated plates 50 and 52, respectively, in shearing relationship thereto.

The drive shaft 30 is provided with a reduced diameter threaded section 74 at its distal end, disposed in the discharge chamber 38, and a splined section 76 adjacent thereto and extending through the comminuting chamber 36. The knives 62 and 64 are provided with splined central openings 78 (FIGS. 3 and 7) through which the splined section 76 extends, to interengage the knives and the drive shaft 30, whereby the knives are driven by rotation of the drive shaft. The knives 62 and 64 are located on the drive shaft 30 by suitable spacing means, including a tubular spacer 79 mounted on the shaft 30 and having a flange 80 thereon adjacent to the face of the upstream knife 64, and a spacing ring 82 secured on the face of the downstream knife 62 by bolts 84. The spacing ring 82 extends rotatably through the central opening 56 in the upstream plate 52 and bears against the back of the upstream knife 64.

An ejector rotor 86 having blades or wings 88 is mounted in the discharge chamber 38 in communication with the downstream side of the downstream valve plate 50. The rotor 86 is mounted on the end of the splined section 76 of the drive shaft 30 by means of a nut 90 in threaded engagement with the threaded section 74 on the end of the shaft. The body 92 of the rotor extends rotatably into the central opening 54 of the downstream perforated plate 50.

Rotation of the drive shaft 30 by means of the motor 26 and the belt drive mechanism 28 serves to rotate together the tubular spacer 79 and the flange 80 thereon, the spacing ring 82, the knives 62 and 64, and the rotor 86. The axial distances of the knives 62 and 64 relative to the perforated plates 50 and 52 may be adjusted by rotation of the handwheel 46, as described in the above-identified patent.

The downstream knife 62 is illustrated in detail in FIGS. 3–8, as representative of both knives 62 and 64, and it is to be understood that the upstream knife 64 has the same construction and arrangement of parts in the illustrative embodiment of the invention. A knife body 93 (FIG. 7) includes a generally cylindrical hub component or portion 94 having the splined circular opening 78 extending axially therethrough. The body 93 also includes three holder components integral with the hub 94, in the form of arms 96 each extending generally in a radially outward direction from the axis of rotation 97 of the knife. An illustrative diameter for the perforated plates 50 and 52 is 225 mm. The diameter of the circle generated by rotation of each knife 62 and 64, i.e., generated at the tips of the arms 96, is about 210 mm. for such plate size. The invention is equally applicable to other plate and knife sizes.

The hub component is provided with a cylindrical recess 98 on its upstream face, which serves to receive one end of the spacer 79 (FIG. 2) therein. A cylindrical recess 100 of greater diameter is provided on the opposite or downstream face of the hub 94 (see FIG. 7). Two diametrically opposed countersunk bolt holes 102 receiving the bolts 84 (FIG. 2) extend from the base of the downstream recess 100, adjacent to the periphery of the recess, to the base of the upstream recess 98. Three blind bores 104 extend into the hub component 94 from its downstream recess 100, equiangularly around the recess and adjacent to its periphery. The blind bores 104 are provided for mounting purposes in other structure, not illustrated.

Figure 5:
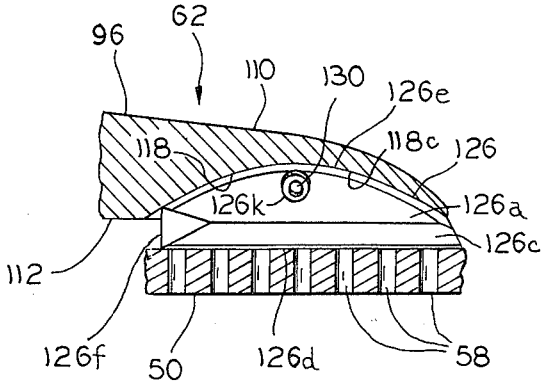
FIG. 5 is a fragmentary cross sectional view of the knife portion illustrated in FIG. 4, on a smaller scale and taken substantially on line 5—5 thereof.

The arms 96 are identical and each includes a serrated-straight line leading cutting edge 106 and a curved trailing edge 108. The leading cutting edge 106 constitutes a segment of a line which intersects the hub 94 as a chord which is not a diameter of the hub-defining circle. The trailing edge 108 initially is generally tangential to the hub 94, and as it extends outwardly, it curves towards the cutting edge 106, so that the arm 96 tapers outwardly. The lines of the edges 106 and 108 intersect the hub 94 on opposite sides of the axis 97. As best seen in FIG. 5, the upstream surface 110 of each arm 96 is inclined outwardly and in the direction of the downstream surface 112 of the arm, the latter surface being in a plane substantially perpendicular to the axis of rotation 97 of the knife, to thereby provide a corresponding taper in the arm.

Figure 4:
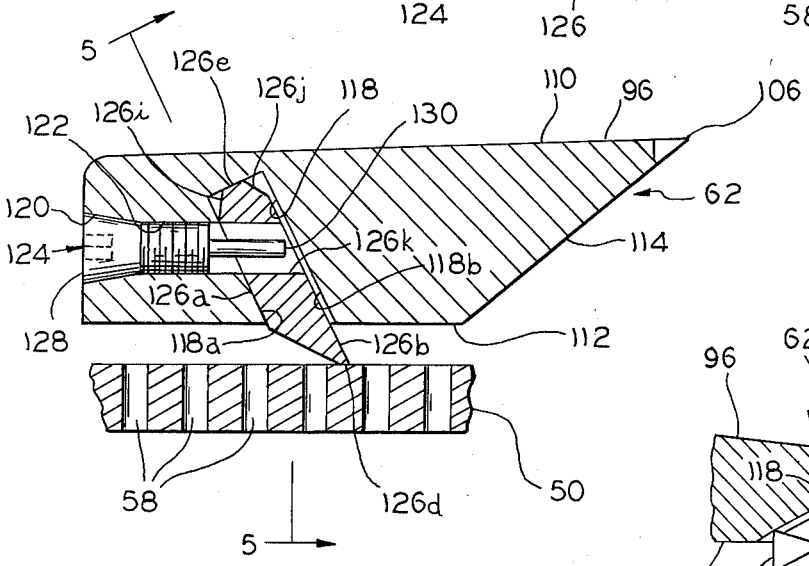
FIG. 4 is a still further enlarged fragmentary sectional view of a high speed rotary propelling knife in the machine, taken substantially on line 4—4 of FIG. 3.

As seen in FIGS. 4 and 7, each arm 96 is provided with an oblique propelling face 114, which extends between the leading cutting edge 106 and the downstream surface 112 thereon, and is inclined from the cutting edge 106 in the direction of the trailing edge 108. The downstream surface 112 is relieved slightly adjacent to the trailing edge 108, as indicated at 116.

As seen most clearly in FIGS. 4 and 5, each arm 96 defines an arcuate-bottom blade-receiving slot 118, which extends inwardly from the downstream surface 112. The slot 118 extends generally in a radially outward direction from the axis of rotation 97, as does the arm 96. The slot 118 extends along segments of lines constituting chords of the hub-defining circle which are not diameters thereof. Opposite flat parallel slot side walls **118*a* and 118*b* lie in planes which are oblique with respect to the axis of rotation 97, extending towards the downstream surface 112, in the direction of the propelling face 114 and the leading cutting edge 106. The bottom or base 118*c* of the slot 118 is curved substantially on the arc of a circle, so that the walls 118*a* and 118*b* of the slot constitute segments of circles subtended by the plane of the downstream surface 112 on the knife. In the illustrative embodiment, the radius of the arc defining the bottom 118*c*** is about 45 mm. (1 25/32 inch) for the above-described knife size.

As seen in FIG. 4, a countersunk opening 120 extends transversely from the trailing edge 108 to the slot 118 in each arm 96. An inner cylindrical portion 122 of the wall bounding the opening 120 is threaded, for receiving a set screw in engagement therewith. Previously, a set screw having a mushrooming head was inserted in the opening 120, and tightened against an indented portion of a blade in the slot 118, to fix the blade rigidly in place, as described above.

In the invention, the blade insert assembly 12 (FIG. 6) replaces the prior set screw having a mushrooming head, and the prior blade. The assembly 12 includes an arbor 124 and a replaceable blade 126. The arbor 124 includes a set screw 128 and an integral pin 130. The set screw 128 includes a key-receiving frusto-conical outer portion 132, and a threaded cylindrical inner portion 134 integral therewith. The pin 130 is cylindrical and substantially smaller in diameter than the inner portion 134, and extends axially outwardly therefrom.

The blade 126, in general, is in the form of a segment of a shallow cylinder, with various surfaces cut away.

Referring particularly to FIGS. 4 and 6, the blade 16 has two flat parallel longitudinally extending outer surfaces 126*a* and 126*b* on opposite sides of the blade. The blade is beveled between the side surfaces at 126*c* and ground to provide a narrow planar longitudinally extending cutting edge 126*d*. A longitudinally arcuate base 126*e* is provided on the blade opposite to the cutting edge 126*d*. The base 126*e* has substantially the same radius as the slot 118 in each arm 96, i.e., about 45 mm. in the illustrative embodiment.

Opposite ends of the blade 126 are, in general, squared or cut off, as indicated at 126*f* and 126*g*. An indicating beveled surface 126*h* extends inwardly from the squared end 126*f* adjacent to the side surface 126*a*. The base 126*e* is beveled along the periphery and on opposite sides thereof, as indicated at 126*i* and 126*j* (see FIG. 4). Except for the bevel 126*j*, the entire side of the blade having the surface 126*b* lies in a single plane.

A cylindrical hole or bore 126*k* extends transversely through the blade 126, approximately at the crest of the base 126*e* and adjacent to the periphery of the blade thereat. The hole 126*k* extends from one side surface 126*a* to the opposite side surface 126*b*, at an acute angle with respect to the surface 126*a* and inclined therefrom in the direction of the cutting edge 126*d*. The diameter of the hole 126*k* is substantially the same as the diameter of the threaded wall portion 122 of the transverse opening 120 in each knife arm, in the illustrative embodiment, whereby the hole 126*k* and the opening 120 may be brought into substantial registry, as illustrated in FIG. 4.

The blade 126 as thus constructed is adapted to be adjustably received in the slot 118 in any of the arms 96, with the base 126*e* of the blade seated on the bottom 118*c* of the slot in conformity thereto. When the cutting edge 126*d* is parallel to the downstream surface 112 on the arm and lies in a plane perpendicular to the axis of rotation 97 of the knife, the cutting edge 126*d* normally also is parallel to the adjacent surface of a new valve plate 50, as illustrated in FIG. 5. The hole 126*k* in the blade then registers with the transverse opening 120 in the arm 96. The blade 126 is adjustable on the arm by rotational sliding movement on its base 126*e*, to positions of the cutting edge 126*d* such as illustrated in broken lines in FIG. 8.

With the blade 126 received in the slot 118 of the arm 96, the arbor 124 is inserted in the transverse opening 120 in the arm, as best illustrated in FIG. 4. The set screw 128 is threaded completely into the inner wall portion 122 around the opening, to cause the pin 130 to extend from one side surface 126*a* of the blade 126 into the hole 126*k* in the blade and for a major proportion of the length of the hole. When the blade 126 is in the slot 118 with its cutting edge 126*d* parallel to the arm surface 112, as described above, the pin 130 is centered in the blade hole 126*k*, as illustrated in FIGS. 4 and 5.

The arbor pin 130 fits loosely in the blade hole 126*k*, for retaining the blade 126 in the slot 118 in the arm 96 while enabling the blade to rock about a transverse axis (with respect to its longitudinal cutting edge 126*d*) for automatically leveling the blade with respect to the plate 50 during assembly with the plate and operation. The blade 126 in the illustrative embodiment is mounted to rock about such transverse axis to the extent of approximately 2–4 degrees in each direction from a position in which its cutting edge 126*d* lies in a plane perpendicular to the axis of rotation 97 of the knife, as represented by the angle of rotation A in FIG. 8. The diameter of the arbor pin 130 in this embodiment is a minor fraction of the diameter of the hole 126*k* in the blade. More specifically, the diameter of the arbor pin 130 is about 1.5 mm., and the diameter of the hole 126*k* is about 4.5 mm. When the set screw 128 is unthreaded from the inner wall portion 122 of the transverse opening 120, it acts to withdraw the integral pin 130 from the blade hole 126*k*, so as to release the blade 126 for replacement thereof.

The complete knives 62 and 64, assembled as described above for the downstream knife 62, may be mounted in the comminuting machine 10 as illustrated in FIG. 2, with no need for a leveling operation or a grinding operation to insure that the cutting edges 126*d* of the knife blades 126 are parallel to the perforated plates 50 and 52. Operation of the handwheel 46 brings the cutting edges 126*d* of the blades 126 to bear on the perforated plates 50 and 52. The cutting edges 126*d* automatically adjust to align with the adjacent surfaces of the plates 50 and 52, in complete contact throughout the length of each cutting edge, with the blades rocking or tilting in their slots 118 as necessary to provide the alignment.

The machine 10 is operated to comminute a foodstuff in the manner described in the above-identified patent. Thus, material to be comminuted is fed into the hopper 34, and the motor 26 is operated to drive the shaft 30. The material passes through the curved inlet portion 40 of the comminuting chamber 36 and to the upstream propelling knife 64. The material is comminuted in the upstream portion of the comminuting chamber 36, passes through the upstream perforated plate 52 into the downstream portion of the comminuting chamber, and there is comminuted and forced through the downstream perforated plate 50 into the discharge chamber 38, from whence it is discharged through the outlet port 42 and the discharge nozzle 44.

Figure 3:
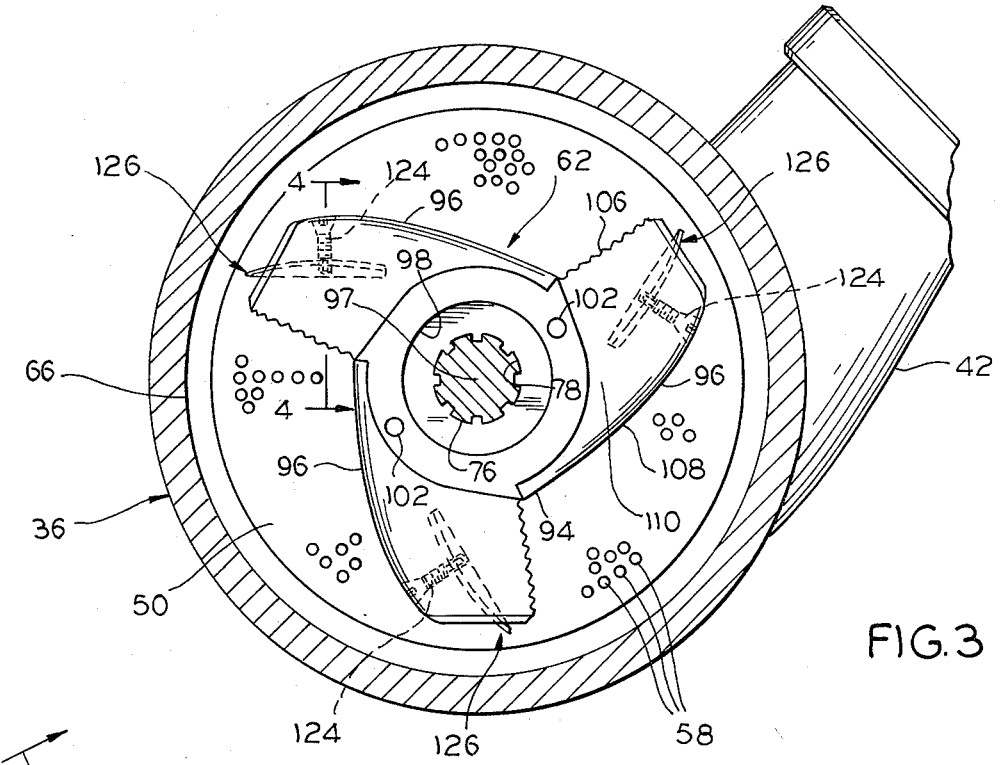
FIG. 3 is a further enlarged cross sectional view of a portion of the machine, taken substantially on line 3—3 of FIG. 2 but with certain parts removed.

Referring to the illustrations of the downstream knife 62 and the downstream perforated plate 50 in FIGS. 3–5, as illustrative of the operation of both knives and perforated plates, the foodstuff is circulated and recirculated towards the knife 62. The foodstuff is cut by the serrated cutting edges 106, which are spaced from the plate 50, and urged towards the plate 50 by the propelling faces 114. The blade cutting edges 126*d*, which trail the serrated cutting edges 106 on respective arms 96, operate in shearing relationship to the perforated plates 50 and 52, and cut off material projecting from the small perforations 58 of the plates in their paths as they traverse the plates.

In the illustrative embodiment, the knives may be rotated at about 3,000 rpm. by a 100 horsepower motor. As operation continues, the knife blades 126 wear. The adjacent surfaces of the perforated plates 50 and 52 also wear, to an extent depending upon the hardness of the surfaces. The handwheel 46 is turned periodically to take up slack caused by the wear, by moving the knives 62 and 64 axially towards the plates 50 and 52. The blades 126 are caused to bear fully on the plates, despite the unevenness of wear, described above, as the blades rock in the slots 118, to automatically level them with respect to the plates. In alternative structure, not illustrated, the knives 62 and 64 or the drive shaft 30 may be spring-loaded, so that the knives are urged against the perforated plates 50 and 52 with constant pressure and the blades 126 constantly adjust to the plates as wear takes place.

When the blades 126 are worn down, the knives 62 and 64 are removed from the machine 10, and the blades are removed and replaced with new blades. When the machine is reassembled with the knives in place, the handwheel 46 is adjusted to bring the new blades 126 up against the plates 50 and 52, at which time the blades are automatically leveled in the manner described above, compensating for any wear on the plate at the same time.

While the blade insert assembly of the invention has been illustrated and described in use in a high speed rotary propelling knife employed in a particular machine for comminuting a foodstuff, the assembly may be employed with like advantages in other high speed rotary knives which rotate adjacent to perforated plates for severing foodstuff projecting from the perforations thereof, and such knives may be employed in other machines. The invention is applicable to machines constructed for vertical travel of a foodstuff, as well as to machines constructed for horizontal travel, as is the illustrative machine 10. The knives may be employed in multiple or singly, the latter as disclosed in other machines illustrated in the above-identified patent, for example. Other specific designs of the body of the knife may be employed. While the specific forms of the illustrative knife blade and arbor, and the specific manner of mounting them are preferred, the invention is not limited thereto. Rather, it will be apparent to those skilled in the art that various changes and modifications may be made in the specific construction and assembly of the knife and the blade insert assembly thereof within the spirit and scope of the invention. It is intended that all such changes and modifications be included within the scope of the claims

I claim:

1. In a high speed rotary knife adapted in operation to rotate adjacent to a perforated plate for severing foodstuff projecting from the plate perforations, said knife including a holder component and a blade held thereby, said holder component defining an arcuate-bottom slot, said blade having a longitudinally extending cutting edge and a longitudinally arcuate base, said slot receiving said blade seated therein with its base at the bottom of the slot in conformity thereto, said base being adjustable on said holder component by rotational sliding movement on its base for leveling its cutting edge with respect to said plate, and said blade traversing said plate with said cutting edge thereagainst in operation, improved means for mounting said blade comprising:

means defining a hole extending transversely in said blade from a side thereof, an arbor extending into said hole from said side, said arbor fitting loosely in said hole for retaining said blade in said slot while enabling the blade to rock about a transverse axis for automatically leveling the blade with respect to said plate during assembly with the plate and operation, and means for mounting said arbor on said holder component while enabling the arbor to be withdrawn from said hole sufficiently to release said blade for replacement thereof.

2. A knife as defined in claim 1 and wherein said blade is mounted to rock about said axis to the extent of approximately 2–4 degrees in each direction from a position in which said cutting edge lies in a plane perpendicular to the axis of rotation of the knife.

3. A knife as defined in claim 1 and wherein said arbor comprises a set screw threadedly engaging said holder component, and a pin on one end of said screw and extending therefrom into said hole.

4. A knife as defined in claim 3 and wherein said blade is mounted to rock about said axis to the extent of approximately 2–4 degrees in each direction from a position in which said cutting edge lies in a plane perpendicular to the axis of rotation of the knife.

5. A knife as defined in claim 4 and wherein said hole and said pin are cylindrically shaped, and the diameter of said pin is a minor fraction of the diameter of said hole.

6. In a machine for comminuting a foodstuff which includes a perforated plate interposed between comminuting and discharge chambers, and a high speed rotary propelling knife in said comminuting chamber and adjacent to said plate, said knife including an arm extending generally in a radially outward direction from its axis of rotation and a blade held thereby, said arm propelling comminuted foodstuff through the plate perforations in operation, said arm defining an arcuate-bottom slot extending generally in said direction, said blade having a longitudinally extending cutting edge and a longitudinally arcuate base, said slot receiving said blade seated therein with its base at the bottom of the slot in conformity thereto and with its cutting edge extending generally in said direction, said blade being adjustable on said arm by rotational sliding movement on its base for leveling its cutting edge with respect to said plate, and said blade traversing said plate with said cutting edge thereagainst in operation, improved means for mounting said blade comprising:

means defining a hole extending transversely in said blade from a side thereof, an arbor extending into said hole from said side, said arbor fitting loosely in said hole for retaining said blade in said slot while enabling the blade to rock about a transverse axis for automatically leveling the blade with respect to said plate during assembly with the plate and operation, and means for mounting said arbor on said arm while enabling the arbor to be withdrawn from said hole sufficiently to release said blade for replacement thereof.

7. A machine as defined in claim 6 and wherein said blade is mounted to rock about said transverse axis to the extent of approximately 2–4 degrees in each direction from a position in which said cutting edge lies in a plane perpendicular to said axis of rotation of said knife.

8. A machine as defined in claim 6 and wherein said arbor comprises a set screw threadedly engaging said arm, and a pin on one end of said screw extending therefrom into said hole.

9. A machine as defined in claim 8 and wherein said blade is mounted to rock about said transverse axis to the extent of approximately 2–4 degrees in each direction from a position in which said cutting edge lies in a plane perpendicular to said axis of rotation of said knife.

10. A machine as defined in claim 9 and wherein said hole and said pin are cylindrically shaped, said hole extends from said side to an opposite side of said blade, and the diameter of said pin is a minor fraction of the diameter of said hole.

11. A blade insert assembly for use in a high speed rotary knife, said knife being adapted in operation to rotate adjacent to a perforated plate for severing foodstuff projecting from the plate perforations, said knife including a holder component which defines an arcuate-bottom slot adapted to receive a blade having an arcuate base seated therein with the base at the bottom of the slot in conformity thereto, the blade so received being adjustable on said holder component by rotational sliding movement on its base for leveling a cutting edge on the blade with respect to said plate, the blade so received being adapted for traversing said plate with said cutting edge thereagainst in operation, and said holder component also defining an opening communicating with said slot and bounded by a threaded wall for receiving a set screw in threaded engagement with the holder component, comprising:

a blade having a longitudinally extending cutting edge and a longitudinally arcuate base, said blade being adapted for such adjustable reception in such a slot and for such traversing of such a plate in operation, means defining a hole extending transversely in said blade from a side thereof, said hole being disposed for communication with such an opening in such holder component when the blade is received in such slot, and an arbor which comprises a. a set screw adapted to be received in such opening in threaded engagement with such holder component, and b. a pin on one end of said screw and adapted for extending therefrom into said hole in said blade when the blade is received in such slot, said pin fitting loosely in said hole for retaining the blade in the slot while enabling the blade to rock about a transverse axis for automatically leveling the blade with respect to such plate during assembly with the plate and operation, said set screw when unthreaded from such holder component acting to withdraw said pin from said hole sufficiently to release said blade for replacement thereof.

12. An assembly as defined in claim 11 and wherein said blade side includes a flat longitudinally extending outer surface parallel to a flat longitudinally extending outer surface on the opposite side of said blade for reception in a holder component slot having two flat parallel side walls with said blade surfaces adjacent and parallel to such slot walls.

13. An assembly as defined in claim 12 and adapted for mounting said blade to rock about said axis to the extent of approximately 2–4 degrees in each direction from a position in which said cutting edge lies in a plane perpendicular to the axis of rotation of such knife.

14. An assembly as defined in claim 13 and wherein said hole extends from said side to an opposite side of said blade.

15. An assembly as defined in claim 11 and adapted for mounting said blade to rock about said axis to the extent of approximately 2–4 degrees in each direction from a position in which said cutting edge lies in a plane perpendicular to the axis of rotation of such knife.

16. An assembly as defined in claim 15 and wherein said hole and said pin are cylindrically shaped, and the diameter of said pin is a minor fraction of the diameter of said hole.

* * * * *